US008079296B2

(12) United States Patent
Barton et al.

(10) Patent No.: US 8,079,296 B2
(45) Date of Patent: Dec. 20, 2011

(54) DEVICE AND METHODS FOR FIRING PERFORATING GUNS

(75) Inventors: John A. Barton, Arlington, TX (US); Lyle W. Andrich, Grandview, TX (US); Timothy Edward LaGrange, Rainbow, TX (US)

(73) Assignee: Owen Oil Tools LP, Houston, TX (US)

( * ) Notice: Subject to any disclaimer, the term of this patent is extended or adjusted under 35 U.S.C. 154(b) by 296 days.

(21) Appl. No.: 12/393,862

(22) Filed: Feb. 26, 2009

(65) Prior Publication Data

US 2010/0000789 A1 Jan. 7, 2010

Related U.S. Application Data

(63) Continuation-in-part of application No. 11/069,600, filed on Mar. 1, 2005, now Pat. No. 7,913,603.

(51) Int. Cl.
*E21B 43/1185* (2006.01)

(52) U.S. Cl. ..... 89/1.15; 175/4.56

(58) Field of Classification Search ..... 89/1.15; 175/4.54, 4.55, 4.56
See application file for complete search history.

(56) References Cited

U.S. PATENT DOCUMENTS

| | | | | |
|---|---|---|---|---|
| 2,171,384 | A | | 8/1939 | Young |
| 2,238,939 | A | | 4/1941 | Lewis et al. |
| 2,377,151 | A | | 5/1945 | Huber |
| 2,558,163 | A | | 6/1951 | Wright et al. |
| 2,590,671 | A | | 3/1952 | Baker |
| 2,819,673 | A | | 1/1958 | Cecil et al. |
| 2,935,020 | A | | 5/1960 | Howard et al. |
| 3,013,492 | A | | 12/1961 | Sexton |
| 3,057,296 | A | | 10/1962 | Silverman |
| 3,131,633 | A | | 5/1964 | Eisler et al. |
| 3,246,602 | A | | 4/1966 | Meredith et al. |
| 3,422,760 | A | | 1/1969 | Mohaupt |
| 3,830,158 | A | * | 8/1974 | Di Phillipo et al. ..... 102/258 |
| 3,926,119 | A | | 12/1975 | Hurst et al. |
| 4,074,629 | A | | 2/1978 | Colgate |
| 4,215,631 | A | | 8/1980 | Rucker |
| RE30,621 | E | | 5/1981 | Calder et al. |
| 4,329,925 | A | | 5/1982 | Hane et al. |
| 4,382,410 | A | | 5/1983 | Bowling et al. |
| 4,425,850 | A | | 1/1984 | Grossler |
| 4,485,876 | A | | 12/1984 | Speller |
| 4,544,034 | A | | 10/1985 | George |
| 4,612,992 | A | | 9/1986 | Vann et al. |
| 4,614,156 | A | | 9/1986 | Colle, Jr. et al. |
| 4,649,822 | A | | 3/1987 | Seeman |
| 4,798,244 | A | | 1/1989 | Trost |
| 4,850,438 | A | | 7/1989 | Regalbuto |
| 5,062,485 | A | | 11/1991 | Wesson et al. |
| 5,078,210 | A | | 1/1992 | George |
| 5,099,763 | A | | 3/1992 | Coursen et al. |
| 5,155,293 | A | | 10/1992 | Barton |

(Continued)

*Primary Examiner* — Stephen M Johnson
(74) *Attorney, Agent, or Firm* — Mossman Kumar & Tyler PC

(57) ABSTRACT

A perforating gun train for perforating two or more zones of interest includes two or more gun sets made up of guns, one or more activators, and other associated equipment. An illustrative apparatus may include a first perforating gun; an activator responsive to the firing of the first perforating gun and a fuse element detonated by the activator; and a second perforating gun that is fired by the fuse element. An illustrative method for perforating a subterranean formation may include forming a perforating gun train using at least a first perforating gun and a second perforating gun; and energetically coupling the first perforating gun and the second perforating gun with an activator.

19 Claims, 4 Drawing Sheets

U.S. PATENT DOCUMENTS 5,223,665 A * 6/1993 Burleson et al. ..... 102/312
5,287,924 A 2/1994 Burleson et al.
5,353,875 A 10/1994 Schultz et al.
5,355,957 A 10/1994 Burleson et al.
5,398,760 A 3/1995 George et al.
5,435,250 A 7/1995 Pollock
5,505,261 A 4/1996 Huber et al.
5,690,171 A 11/1997 Winch et al.
5,887,654 A 3/1999 Edwards et al.
5,890,539 A 4/1999 Huber et al.
5,971,072 A 10/1999 Huber et al.
6,085,843 A 7/2000 Edwards et al.
6,182,750 B1 2/2001 Edwards et al.
6,213,203 B1 4/2001 Edwards et al.
6,354,374 B1 3/2002 Edwards et al.
6,631,684 B2 10/2003 Kang
6,666,141 B2 12/2003 Hagerty
6,679,175 B2 1/2004 Gavrilovic
7,104,326 B2 9/2006 Grattan et al.
7,210,409 B2 5/2007 Johnson
7,306,038 B2 12/2007 Challacombe
7,591,212 B2 * 9/2009 Myers et al. ..... 89/1.15
2001/0027864 A1 10/2001 Vaynshteyn
2003/0150622 A1 8/2003 Patel et al.
2006/0185898 A1 * 8/2006 Seekford ..... 175/4.6
2006/0196665 A1 9/2006 LaGrange et al.

* cited by examiner

DEVICE AND METHODS FOR FIRING PERFORATING GUNS

CROSS-REFERENCE TO RELATED APPLICATIONS

This application is a continuation in part of U.S. patent application Ser. No. 11/069,600, filed on Mar. 1, 2005 now U.S. Pat. No. 7,913,603.

BACKGROUND OF THE DISCLOSURE

1. Field of the Disclosure

The present disclosure relates to devices and methods for selective actuation of wellbore tools. More particularly, the present disclosure is in the field of control devices and methods for selective firing of a gun assembly.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string. In wells that have long or substantial gaps between zones, an operator must consider the efficiency and cost of perforating the zones. The zones can be perforated separately via multiple trips into the well, which requires running the work string in and out of the well for each zone to be perforated. This increases rig and personnel time and can be costly.

These conventional firing systems for various reasons, such as capacity, reliability, cost, and complexity, have proven inadequate for these and other applications. The present disclosure addresses these and other drawbacks of the prior art.

SUMMARY OF THE DISCLOSURE

In aspects, the present disclosure provides an apparatus for perforating a subterranean formation. The apparatus may include a first perforating gun; an activator responsive to the firing of the first perforating gun and a fuse element detonated by the activator; and a second perforating gun having a detonator activated by the fuse element. In arrangements, a first detonator cord may explosively couple the first perforating gun to the activator. Also, in embodiments, the activator may include an energetic material, a pin positioned adjacent to the energetic material, and an igniter positioned adjacent to the pin. A shock wave generated by the energetic material may propel the pin into the igniter. In such embodiments, the igniter may include an energetic material that detonates the fuse element. In further arrangements, the apparatus may include a second detonator cord explosively coupled to the second perforating gun; and a detonator energetically coupling the second detonator cord to the fuse element. Also, the apparatus may include a housing that receives the firing pin and a frangible element that connects the firing pin to the housing. The frangible element may break in response to the shock wave generated by the energetic material. In arrangements, the fuse element may deflagrate. In applications, a second detonator cord associated with the second perforating gun may be explosively coupled to the fuse element.

In aspects, the present disclosure also provides a perforating apparatus that may include a first perforating gun that has a pressure activated firing head; an activator that may include a firing head responsive to the detonation of the first perforating gun and an igniter detonated by the firing head; and a fuse element including an energetic material, the fuse element energetically coupled to and detonated by the igniter; and a second perforating gun having a detonator activated by the fuse element. The apparatus may also include a detonator cord and a booster element that energetically couple the first perforating gun to the activator. Further, the apparatus may include a second detonator cord and a second booster element that energetically couple the fuse element to the second perforating gun.

In aspects, the present disclosure also provides a method for perforating a subterranean formation. The method may include forming a perforating gun train using at least a first perforating gun and a second perforating gun that has a detonator; energetically coupling the first perforating gun and the second perforating gun; firing the first perforating gun; and firing the second perforating gun. The energetic coupling may include an activator responsive to the firing of the first perforating gun; and a fuse element detonated by the activator. The fuse element may activate the detonator of the second perforating gun. The method may further include conveying the perforating gun train into a wellbore formed in the subterranean formation. In certain deployments, the method may involve firing the first perforating, wherein the firing of the first perforating gun initiates the firing of the second perforating gun.

In aspects, the present disclosure further provides a perforating method that may include forming a perforating gun train using a first perforating gun and a second perforating gun; and energetically coupling the first perforating gun and the second perforating gun using an activator and a fuse element. The activator may include a firing head responsive to the detonation of the first perforating gun; and an igniter configured to be detonated by the firing head. The fuse element may include an energetic material that is energetically coupled to and detonated by the igniter.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE DISCLOSURE

Figure 1:
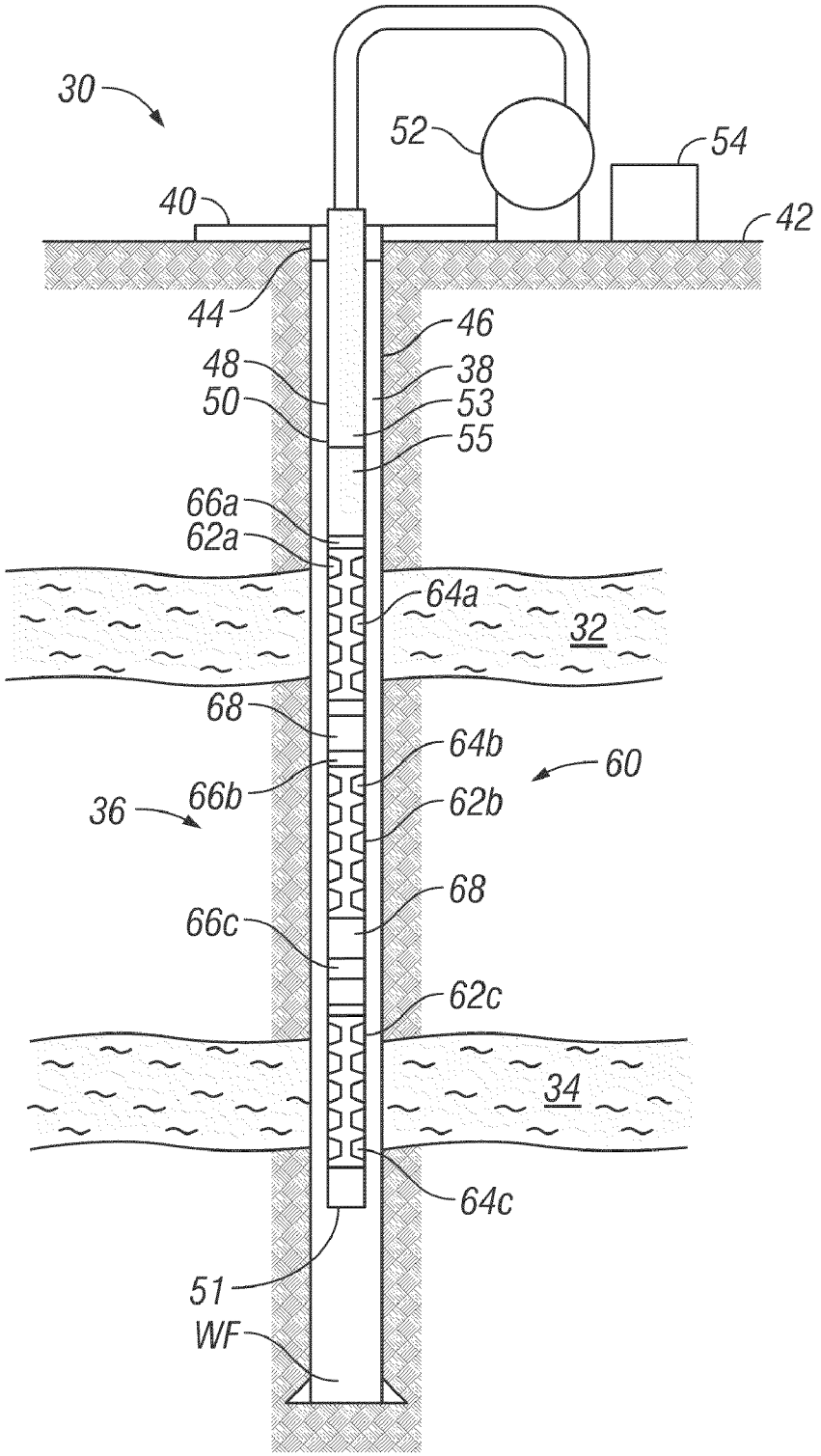
FIG. 1 schematically illustrates a deployment of a perforating gun train utilizing one embodiment of the present disclosure.

The present disclosure relates to devices and methods for firing two or more downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown a well construction and/or hydrocarbon production facility 30 positioned over subterranean formations of interest 32, 34 separated by a gap section 36. The teachings of the present disclosure, however, may be applied to any type of subsurface formation. The facility 30 can be a land-based or offshore rig adapted to drill, complete, or service a wellbore 38. The wellbore 38 can include a wellbore fluid WF that is made up of formation fluids such as water or hydrocarbons and/or man-made fluids such as drilling fluids. The facility 30 can include known equipment and structures such as a platform 40 at the earth's surface 42, a wellhead 44, and casing 46. A work string 48 suspended within the well bore 38 is used to convey tooling into and out of the wellbore 38. The work string 48 can include coiled tubing 50 injected by a coiled tubing injector 52. Other work strings can include tubing, drill pipe, wire line, slick line, or any other known conveyance means. The work string 48 can include telemetry lines or other signal/power transmission mediums that establish one-way or two-way telemetric communication from the surface to a tool connected to an end of the work string 48. A suitable telemetry system (not shown) can be known types as mud pulse, electrical signals, acoustic, or other suitable systems. A surface control unit (e.g., a power source and/or firing panel) 54 can be used to monitor and/or operate tooling connected to the work string 48.

In one embodiment of the present disclosure, a perforating gun train 60 is coupled to an end of the work string 48. An exemplary gun train includes a plurality of guns or gun sets 62*a-c*, each of which includes perforating shaped charges 64*a-c*, and detonators or firing heads 66*a-c*. To control the time delay between successive firings, the guns 62*a-c* are operatively connected to one another by an activator 68. Other equipment associated with the gun train 60 includes a bottom sub 51, a top sub 53, and an accessories package 55 that may carry equipment such as a casing collar locator, formation sampling tools, casing evaluation tools, etc. Tubular members such as subs may be used to physically or structurally interconnect the guns 62*a-c*. It should be understood that more than the perforating gun train 60 can include two or more guns. Also, while a 'top-down' firing sequence is described, it should be understood that a 'bottom-up' sequence may also be utilized. That is, instead of the top most gun being fired first with the lower guns sequentially firing, the bottom most gun may be fired with the upper guns sequentially firing.

Figure 2A:
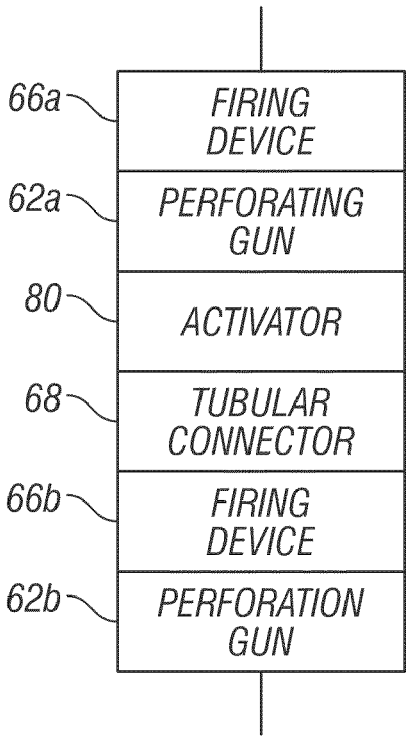
FIG. 2A schematically illustrates one embodiment of the present disclosure that is adapted to selectively permit transmission of signals to a downhole tool.

Referring now to FIG. 2A, the energy released by the gun 62*a* can also be used to indirectly initiate a firing sequence for gun 62*b*. In FIG. 2A, an activator 80 is used to initiate the firing sequence for gun 62*b* while the energy released by the gun 62*a* is used to actuate the activator 80. The activator 80 can be actuated explosively, mechanically, electrically, chemically or other suitable method. For example, the energy release may include a high detonation component that detonates material in the activator 80, a pressure component that moves mechanical devices in the activator 80, or a vibration component that jars or disintegrates structural elements in the activator 80. When actuated, the activator 80 transmits an activation signal, such as a pressure change, electrical signal, or projectile, to the firing head 66*b* of the gun 62*b*. The type of activation signal will depend on the configuration of the firing head 66*b*, i.e., whether it has pressure sensitive sensors, a mechanically actuated pin, electrically actuated contact, etc.

Figure 2B:
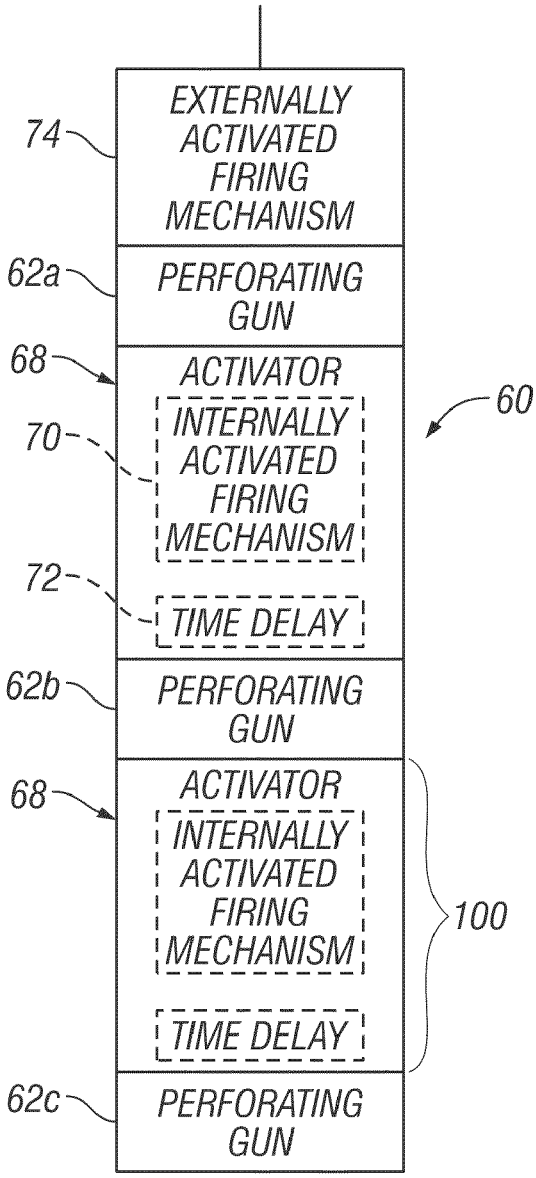
FIG. 2B schematically illustrates an embodiment of the present disclosure that is adapted to selectively permit transmission of signals to a downhole tool using a time delay.

In certain embodiments, the tubular connector may be omitted and the activator may utilize operational features such as a time delay. Referring now to FIG. 2B, there is shown in functional block diagram format another embodiment of an activator 68 that may be used to initiate the firing of and/or control one or more characteristics of a firing sequence for the guns 62*a-c*. The activator 68 may include an internally activated initiator 70 and a time delay mechanism 72. An externally activated firing head 74 may be used to fire the first perforating gun 62*a*. By "externally activated" firing head, it is meant that a signal or condition external to or not associated with the perforating guns 62*a-c* actuates the initiator. Such signals or conditions include, but are not limited to, a surface transmitted signal, a "drop bar," wellbore conditions such as pressure and/or temperature (e.g., a firing device actuated upon detection of one or more specified wellbore conditions), time (e.g., a firing head coupled to a timer), etc. The activator 68 may be constructed to initiate the firing sequence for gun 62*b* in response to the firing of the gun 62*a*. The internally activated initiator 70 may be triggered explosively, mechanically, electrically, chemically or other suitable method. The time delay mechanism 72 may be constructed to control the time interval between the firing of the gun 62*a* and 62*b*. As noted above, in configurations where the perforating gun 60 includes a third gun 62*c*, a second firing control device 100 may be inserted between the second gun 62*b* and the third gun 62*c*. Of course, a similar arrangement may be used to add four or more guns.

Figure 3:
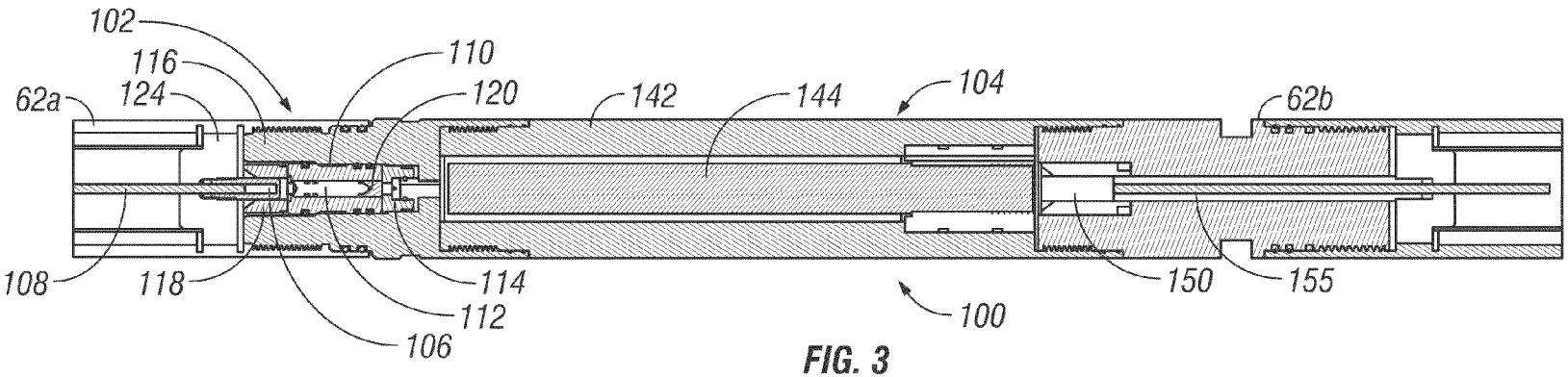
FIG. 3 schematically illustrates a firing system according to one embodiment of the present disclosure.

Referring now to FIG. 3, there is shown further details of an activator that, for convenience, will be referred to as a firing control device 100. In one embodiment, the firing control device 100 includes an initiator 102 and a time delay 104. The initiator 102 may include an explosive booster charge 106 that is energetically coupled to a detonator cord 108 associated with an immediately adjacent perforating gun 62*a*, a firing pin housing 110 that receives a firing pin 112, and an igniter assembly 114. These components may be positioned within a housing 116. The booster charge 106 may include an energetic material that, when detonated, generates a shock wave or pressure pulse that is applied to the firing pin 112. In arrangements, a retainer 118 may be used to house and retain the booster charge 106. The retainer 118 may also contain the energy released by the booster charge 106 in a manner that protects or shields the housing 110 from the detonation. The firing pin housing 110 includes a bore 120 in which the firing pin 112 translates. The housing 110 may also be configured to protect the housing 116 from detonation effects associated with the firing of the perforating gun 62*a* and booster charge 106. A portion of the booster charge 106 may be retained in an end cap 124.

Figure 4:
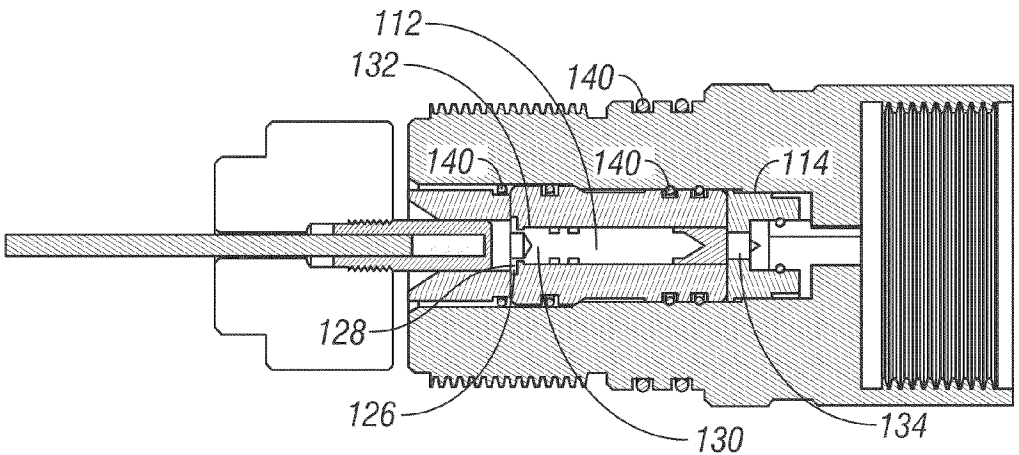
FIG. 4 schematically illustrates further details of the FIG. 3 embodiment.

In one embodiment, the firing pin 112 may be calibrated to maintain structural integrity when exposed to a base line or normal operating pressure and break when subjected to a shock associated with a firing of the booster charge 106. As best seen in FIG. 4, in one arrangement, the firing pin 112 may include a protrusion 126 that seats within a recess 128. For example, the protrusion 126 may be formed as a flange that rests inside a machined groove. The protrusion 126 may be coupled or attached to a body 130 of the pin 112 with a tube 132 or other frangible element that breaks when subjected to a force or stress of a predetermined magnitude. When released from the protrusion 126, the firing pin body 130 is propelled by the detonation force of the booster charge 106 into and against the igniter assembly 114 with sufficient force to cause the igniter assembly 114 to detonate. The igniter assembly 114 includes an energetic material that is capable of igniting the time delay mechanism 104 (FIG. 3). Additionally, seals 140 may be utilized to provide a liquid-tight, gas-tight, or fluid-tight, environment for the booster charge 106, the firing pin 112 and the igniter assembly 114.

In embodiments, the time delay mechanism 104 may include a housing 142 and one or more fuse(s) element 144 that is/are energetically coupled to a detonator 150 of an adjacent gun (e.g., gun 62*c*). In embodiments, a time delay mechanism adjusts or controls the time needed for the energy train to travel to the detonator 150 for the gun 62*b*. By adjustable or controllable, it is meant that the time delay mechanism 104 can be configured to increase or decrease the time between the firing of the first gun 62*a* and the eventual firing of the gun 62*b*. In one embodiment, the time delay mechanism 104 includes a combination of energetic materials, each of which exhibit different burn characteristics, e.g., the type or rate of energy released by that material. By appropriately configuring the chemistry, volume, and positioning of these energetic materials, a desired or predetermined time delay can be in the firing sequence. Generally, the energetic materials can include materials such as RDX, HMX that provides a high order detonation and a second energetic material that provides a low order detonation. The burn rate of an energetic material exhibiting a high order detonation, or high order detonation material, is generally viewed as instantaneous, e.g., on the order of microseconds or milliseconds. The burn rate of an energetic material exhibiting a low order detonation, or low order detonation material, may be on the order of seconds. In some conventions, the high order detonation is referred to simply as a detonation and the low order detonation is referred to as a deflagration. Also, the number of fuses 144 may be varied to control the duration of the time delay.

In variants, the time delay mechanism 104 may utilize other methodologies for activating the detonator 150. For instance, the detonator 150 may incorporate a pressure activated device. Thus, the time delay mechanism 104 may apply a pressure or other induced generated force in sufficiency to break a shear pin or other similar element and allow the firing pin to impact a detonator or igniter. In other variants, a shear stud could be used in place of "shear pins" to function with the application of pressure, differential pressure or other method or device that would generate a sufficient force to cause failure of the shear stud and allow the firing pin to impact a detonator or igniter. Shear studs and shear pins are representative of calibrated frangible elements that utilize material(s) and machining methods that allow these elements to withstand a determined amount of force until ultimate failure. In embodiments, a rupture disc may be used to withstand a predetermined amount of pressure or force and fail at a know amount of pressure or force to allow pressure or force to act against a piston or firing pin to and allow the firing pin to impact a detonator or igniter. Similarly, a bulkhead, which is machined directly into the component, may be fabricated to fail at a known application of pressure or force to allow the firing pin to impact a detonator or igniter. In these variants, the components are configured to withstand pressure from the well up to a predetermined amount and then to fail in such a way as to activate or cause to be activated other components to cause the successful functioning of a detonator or igniter.

The configuration of the detonator 150 may depend on the nature of the energy transfer from the time delay mechanism 104 to the adjacent gun 62*b*. In some embodiments, the detonator 150 may utilize an energetic material, such as but not limited to those described above, formed as a booster element or charge to transform a deflagration input to a high-order detonation output. Also, the detonator 150 may utilize a firing head to generate a high-order detonation output from a deflagration input or firing signal (e.g., pressure increase). In embodiments where a high-order detonation is the input, then the detonator 150 may be configured to transfer the high-order detonation to the adjacent gun 62*b* via a suitable energetic connection.

Referring now to FIGS. 1-3, in an illustrative deployment, the gun train 60 is assembled at the surface and conveyed into the wellbore via a coiled tubing or standard tubing 50. After the gun system 60 is positioned adjacent a zone to be perforated, a firing signal is transmitted from the surface to the gun system 60. This firing signal may be caused by increasing the pressure of the fluid in the wellbore via suitable pumps (not shown), an electrical signal, or a dropped device such as a bar. Upon receiving the firing signal, the firing head 68 generates a high order detonation that fires the perforating gun 62*a*. This detonation may be transmitted to the firing control mechanism 100 via the detonator cord 108. Upon being detonated by the detonator cord 108, this high order detonation also actuates the activator 102. For example, the high-order detonation of the detonator cord 108 detonates the booster charge 106, which in response, generates a shock wave or pressure pulse. The shock wave breaks the connection between the protrusion 126 and the body 130 of the pin 112. The now-released firing pin body 130 is propelled by the shock wave into and against the igniter assembly 114 with sufficient force to cause the igniter assembly 114 to detonate. The igniter assembly 114 detonates the fuse element 144, which then burns for a predetermined amount of time. Eventually, the fuse element 144 transfers the high-order detonation to the detonator 150 of the second perforating gun 62*b*. The detonator 150 thereafter detonates the detonator cord 155 of the second perforating gun 62*b*, which causes the second perforating gun 62*b* to fire.

In some situations, the time delay between the firing of successive guns may be used to facilitate the surface monitoring of the firings and to determine whether all the guns have fired. In other situations, the time delay may be used to move the gun train from one depth to another in a wellbore. For example, referring now to FIG. 1, the gun 36 may be initially positioned at a depth corresponding with the reservoir 34. Once so positioned, the gun may be fired by actuating the externally activated firing head 66*a*. The subsequent firing of gun 62*a* activates the activator 68 and it's time delay device. During the time delay, the gun 36 may be moved to a depth corresponding with the reservoir 32. Once the time delay expires, the gun 62*b* fires. This process may be repeated as necessary for any remaining guns in the gun train.

Figure 5:
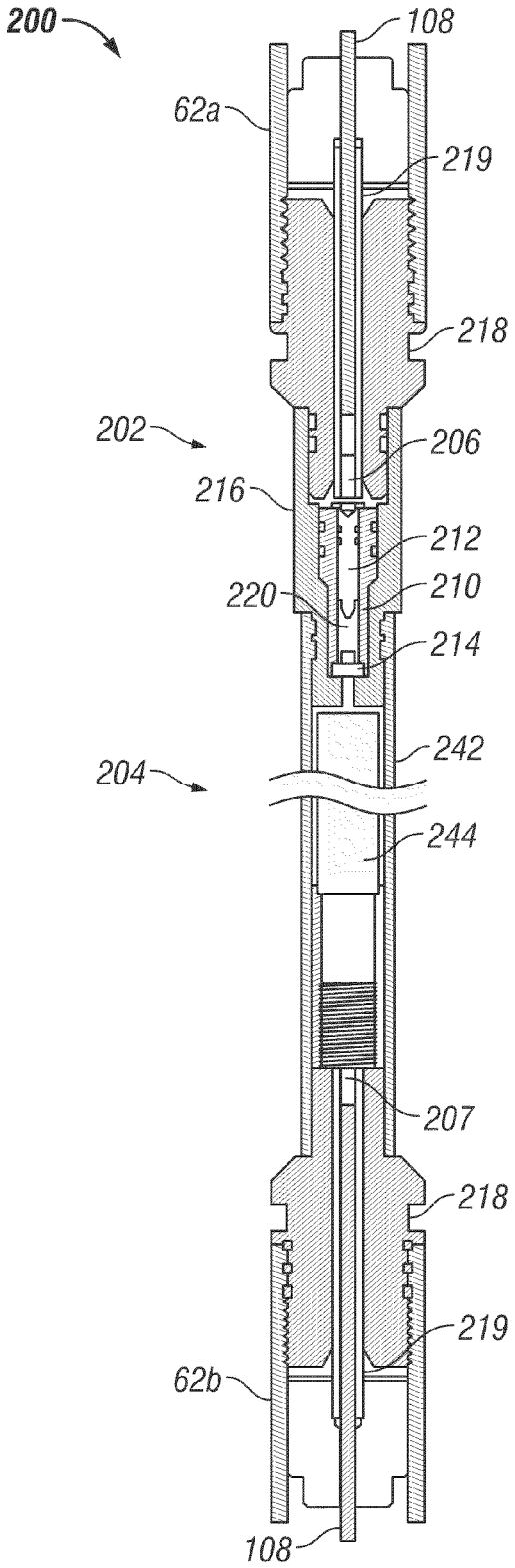
FIG. 5 schematically illustrates another firing system according to one embodiment of the present disclosure.

Referring now to FIG. 5, there is shown another embodiment of a firing control device 200. In one embodiment, the firing control device 200 includes an initiator 202 and a time delay 204. The initiator 202 may include an explosive booster charge 206 that is energetically coupled to a detonator cord 108 associated with an immediately adjacent perforating gun 62*a*, a firing pin housing 210 that receives a firing pin 212, and an igniter assembly 214. These components may be positioned within a housing 216, which has a bore 220 in which the firing pin 212 translates. The booster charge 206 may include an energetic material that, when detonated, generates a shock wave or pressure pulse that is applied to the firing pin 212. As described previously, the firing pin 212 may be calibrated to maintain structural integrity when exposed to a base line or normal operating pressure and break when subjected to a shock associated with a firing of the booster 206. Illustrative structural details for and operation of a firing pin has been discussed in connection with the firing pin 112 of FIG. 4 and will not be repeated here. The igniter assembly 214 includes an energetic material that is capable of igniting the time delay mechanism 82 (FIG. 3), an embodiment of which is shown as the time delay mechanism 204.

In embodiments, the time delay mechanism 204 may include a housing 242 and one or more fuse element(s) 244 that is/are energetically coupled to an adjacent gun (e.g., gun 62*b*). An exemplary energetic coupling may include a booster charge 207 that is coupled to a detonator cord 108. In embodiments, the time delay mechanism adjusts or controls the time needed for the energy train to travel to the gun 62*b*. By adjustable or controllable, it is meant that the time delay mechanism 204 can be configured to increase or decrease the time between the firing of the first gun 62*a* and the eventual firing of the gun 62*b*. As described previously, the time delay mechanism 204 includes a combination of energetic materials, each of which exhibit different burn characteristics, e.g., the type or rate of energy released by that material. The time delay may also be varied by varying the number of time delay fuses.

In embodiments, the firing control device 200 may be inserted into a gun train by using subs 218. The subs 218 may be constructed as modular elements that may be selected to mate with different diameter sizes of perforating guns. A tube 219 secures the detonator cord 108 within a bore of the sub 218 and ensures that the boosters 206, 207 are held in the proper position; i.e., within a distance across which the explosive energy can be conveyed to the firing head and fuse, respectively.

In an illustrative deployment, the firing of the perforating gun 62*a* detonates the detonator cord 108 leading to the initiator 202. In turn, the detonator cord 108 actuates the initiator 202. For example, the high-order detonation of the detonator cord 108 detonates the booster charge 206, which in response, generates a shock wave or pressure pulse. The shock wave releases and propels the firing pin 212 into and against the igniter assembly 214 with sufficient force to cause the igniter assembly 214 to detonate. The igniter assembly 214 detonates the fuse element(s) 244, which then burns for a predetermined amount of time. Eventually, the fuse element 244 transfers the high-order detonation to the booster charge 207 and associated detonator cord 108 of the second perforating gun 62*b*. The detonator cord 108 fires the second perforating gun 62*b*. The firing pin 212 may include sealing elements that provide fluid isolation after detonation.

From the above, it should be appreciated that what has been described includes, in part, an apparatus for perforating a subterranean formation. The apparatus may include a first and a second perforating gun, an activator responsive to the firing of the first perforating gun and a fuse element detonated by the activator that fires the second perforating gun. The second perforating gun may include a detonator that is activated by the fuse element. The detonator may be a firing head, a booster element formed of an energetic material, or other device suitable for outputting a high-order detonation. In arrangements, a first detonator cord may explosively couple the first perforating gun to the activator. Also, in embodiments, the activator may include an energetic material, a pin positioned adjacent to the energetic material, and an igniter positioned adjacent to the pin. A shock wave generated by the energetic material may propel the pin into the igniter. In such embodiments, the igniter may include an energetic material that detonates the fuse element. In further arrangements, the apparatus may include a second detonator cord explosively coupled to the second perforating gun; and a detonator energetically coupling the second detonator cord to the fuse element. Also, the apparatus may include a housing that receives the firing pin and a frangible element that connects the firing pin to the housing. The frangible element may break in response to the shock wave generated by the energetic material. In arrangements, the fuse element may deflagrate. In applications, a second detonator cord associated with the second perforating gun may be explosively coupled to the fuse element.

From the above, it should be appreciated that what has been described includes, in part, a perforating apparatus that may include a first perforating gun that has a pressure activated firing head; an activator that may include a firing head responsive to the detonation of the first perforating gun and an igniter detonated by the firing head; and a fuse element including an energetic material, the fuse element being energetically coupled to and detonated by the igniter; and a second perforating gun having a detonator fired by the fuse element. The apparatus may also include a detonator cord and a booster element that energetically couple the first perforating gun to the activator. Further, the apparatus may include a second detonator cord and a second booster element that energetically couple the fuse element to the second perforating gun.

From the above, it should be appreciated that what has been described includes, in part, a method for perforating a subterranean formation. The method may include forming a perforating gun train using at least a first perforating gun and a second perforating gun; and energetically coupling the first perforating gun and the second perforating gun with an activator responsive to the firing of the first perforating gun; and a fuse element detonated by the activator. The method may further include conveying the perforating gun train into a wellbore formed in the subterranean formation. In certain deployments, the method may involve firing the first perforating, wherein the firing of the first perforating gun initiates the firing of the second perforating gun.

From the above, it should be appreciated that what has been described includes, in part, a perforating method that may include forming a perforating gun train using a first perforating gun and a second perforating gun; and energetically coupling the first perforating gun and the second perforating gun using an activator and a fuse element. The activator may include a firing head responsive to the detonation of the first perforating gun; and an igniter configured to be detonated by the firing head. The fuse element may include an energetic material that is energetically coupled to and detonated by the igniter.

The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. For example, while a "top down" firing sequence has been described, suitable embodiments can also employ a "bottom up" firing sequence.

Moreover, the activator can be used to supplement the energy release of a perforating gun to initiate the firing sequence rather than act as the primary or sole device for initiating the firing sequence. It is intended that the following claims be interpreted to embrace all such modifications and changes.

The invention claimed is:

1. An apparatus for perforating a subterranean formation, comprising:

a first perforating gun that is configured to perforate the subterranean formation;

an activator responsive to the firing of the first perforating gun, wherein the activator includes an energetic material, a pin positioned adjacent to the energetic material, and an igniter positioned adjacent to the pin, wherein a shock wave generated by the energetic material propels the pin into the igniter;

a fuse element detonated by the activator; and a second perforating gun that is configured to perforate the subterranean formation, the second perforating gun having a detonator activated by the fuse element.

2. The apparatus according to claim 1 further comprising a first detonator cord explosively coupling the first perforating gun to the activator.

3. The apparatus according to claim 1 wherein the igniter includes an energetic material that detonates the fuse element.

4. The apparatus according to claim 1 further comprising a housing configured to receive the pin, and wherein the pin includes a frangible element connecting the pin to the housing, wherein the frangible element is configured to break in response to the shock wave generated by the energetic material.

5. The apparatus according to claim 1 further comprising a second detonator cord explosively coupled to the second perforating gun; and the detonator energetically couples the second detonator cord to the fuse element.

6. The apparatus according to claim 1 wherein the detonator is a booster element formed of an energetic material.

7. The apparatus according to claim 1 wherein the detonator is a firing head.

8. A method for perforating a subterranean formation, comprising:

forming a perforating gun train using at least a first perforating gun and a second perforating gun, the second perforating gun having a detonator; and energetically coupling the first perforating gun and the second perforating gun with:

an activator responsive to the firing of the first perforating gun, wherein the activator includes an energetic material, a pin positioned adjacent to the energetic material, and an igniter positioned adjacent to the pin, wherein a shock wave generated by the energetic material propels the pin into the igniter; and a fuse element detonated by the activator;

firing the first perforating gun; and firing the second perforating gun by using the fuse element to activate the detonator of the second perforating gun.

9. The method of claim 8 further comprising conveying the perforating gun train into a wellbore formed in the subterranean formation.

10. The method of claim 8 further comprising firing the first perforating gun, wherein the firing of the first perforating gun initiates the firing of the second perforating gun.

11. The method of claim 8 further comprising explosively coupling the first perforating gun to the activator with a first detonator cord and a first booster; and explosively coupling the fuse element to the detonator.

12. A method for perforating a subterranean formation, comprising:

(a) forming a perforating gun train using a first perforating gun and a second perforating gun, the second perforating gun having a detonator; and (b) energetically coupling the first perforating gun and the second perforating gun using an activator and a fuse element, the fuse element including an energetic material, the activator including:

an energetic material, a pin positioned adjacent to the energetic material, an igniter positioned adjacent to the pin, wherein a shock wave generated by the energetic material propels the pin into the igniter, a housing configured to receive the pin, a frangible element connecting the pin to the housing, wherein the frangible element is configured to break in response to the shock wave generated by the energetic material;

a firing head responsive to the detonation of the first perforating gun and configured to detonate the igniter.

13. The method of claim 12 further comprising conveying the perforating gun train into a wellbore formed in the subterranean formation.

14. The method of claim 12 further comprising firing the first perforating gun by detonating a pressure activated firing head associated with the first perforating gun.

15. The method of claim 12 further comprising energetically coupling the first perforating gun to the activator with a first detonator cord and a first booster element; wherein the detonator includes a booster element energetically coupled to the fuse element.

16. An apparatus for controlling a perforating gun train used to perforate a subterranean formation, the perforating gun train including a first perforating gun that generates a firing signal and a second perforating gun, the apparatus comprising:

a housing configured to connect to the first perforating gun to the second perforating gun;

an activator positioned in the housing, the activator being responsive to the firing signal of the first perforating gun, wherein the activator includes an energetic material, a pin positioned adjacent to the energetic material;

a frangible element connecting the pin to the housing, wherein the frangible element is configured to break in response to the shock wave generated by the energetic material to release the pin;

an igniter positioned adjacent to the pin, the igniter being configured to be detonated by the released pin; and a fuse element detonated by the igniter, the fuse element configured to initiate the firing of the second perforating gun.

17. An apparatus of claim 16, further comprising a seal for forming a fluid-tight seal in the housing.

18. An apparatus of claim 16, further comprising a pin housing having a bore, wherein the pin translates in the bore.

19. An apparatus of claim 16, wherein the activator is configured to energetically couple with a detonator cord associated with the first perforating gun.

* * * * *

UNITED STATES PATENT AND TRADEMARK OFFICE

CERTIFICATE OF CORRECTION

PATENT NO. : 8,079,296 B2
APPLICATION NO. : 12/393862
DATED : December 20, 2011
INVENTOR(S) : John A. Barton et al.

It is certified that error appears in the above-identified patent and that said Letters Patent is hereby corrected as shown below:

At column 10, line 40, please delete "connect to the" and insert therefor -- connect the --.

Signed and Sealed this
Twenty-seventh Day of March, 2012

David J. Kappos

David J. Kappos
*Director of the United States Patent and Trademark Office*